US006843309B2

(12) United States Patent
Taniguchi et al.

(10) Patent No.: US 6,843,309 B2
(45) Date of Patent: Jan. 18, 2005

(54) CONDENSER

(75) Inventors: Hiroyoshi Taniguchi, Wako (JP); Tsuneo Endoh, Wako (JP); Tsutomu Takahashi, Wako (JP); Taizou Kitamura, Wako (JP); Takashi Takazawa, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 15 days.

(21) Appl. No.: 10/182,196

(22) PCT Filed: Jan. 25, 2001

(86) PCT No.: PCT/JP01/00491

§ 371 (c)(1),
(2), (4) Date: Nov. 15, 2002

(87) PCT Pub. No.: WO01/55660

PCT Pub. Date: Aug. 2, 2001

(65) Prior Publication Data

US 2003/0089488 A1 May 15, 2003

(30) Foreign Application Priority Data

Jan. 25, 2001 (JP) ..... 2000-021817

(51) Int. Cl.[7] ..... F28B 1/18

(52) U.S. Cl. ..... 165/112; 165/110; 165/120; 165/123

(58) Field of Search ..... 165/112, 110, 165/120, 123, 167

(56) References Cited

U.S. PATENT DOCUMENTS

| | | | | | |
|---|---|---|---|---|---|
| 3,686,867 | A | * | 8/1972 | Hull | 60/667 |
| 4,224,797 | A | * | 9/1980 | Kelly | 60/652 |
| 4,818,475 | A | * | 4/1989 | Gluntz et al. | 376/282 |
| 5,255,635 | A | * | 10/1993 | Schafer et al. | 123/41.2 |
| 6,332,321 | B1 | * | 12/2001 | Bronicki et al. | 60/728 |

FOREIGN PATENT DOCUMENTS

| | | |
|---|---|---|
| JP | 62-8570 U | 1/1987 |
| JP | 63-201492 A | 8/1988 |
| JP | 4-116346 A | 4/1992 |
| JP | 10-185458 A | 7/1998 |

* cited by examiner

*Primary Examiner*—Allen J. Flanigan
(74) *Attorney, Agent, or Firm*—Birch, Stewart, Kolasch & Birch, LLP

(57) ABSTRACT

A condenser includes a cooling section having a plurality of vapor passages to convert vapor into water, a blower for drawing water produced in the vapor passages out of the vapor passages, and a recovery section for receiving the drawn-out water. Thus, the water produced in the vapor passages in the cooling section can be prevented from occluding the vapor passages.

10 Claims, 10 Drawing Sheets

CONDENSER

This application is the national phase under 35 U.S.C. § 371 of PCT International Application No. PCT/JP01/00491 which has an International filing date of Jan. 25, 2001, which designated the United States of America.

FIELD OF THE INVENTION

The present invention relates to a condenser for converting an operating medium in a gas-phase state into a liquid-phase state.

BACKGROUND ART

There is such a conventionally known condenser including a cooling section in which a large number of narrow passages for cooling medium such as air and a large number of narrow vapor passages are disposed alternately.

If the vapor passages are narrow, however, there is a possibility that the following disadvantage may be encountered: the operating medium in the liquid-phase state produced in such passages, e.g., water occludes the passages due to factors such as a surface tension of the operating medium and as a result, the amount of water vapor flowing in the cooling section is reduced, resulting in a reduction in condensing performance.

DISCLOSURE OF THE INVENTION

It is an object of the present invention to provide a condenser of the above-described type, wherein the operating medium in the liquid-phase state produced in the passages in the cooling section can be prevented from occluding the passages.

To achieve the above-described object, according to the present invention, there is provided a condenser comprising a cooling section having a plurality of operating medium passages to convert an operating medium in a gas-phase state into a liquid-phase state, a suction means for drawing the operating medium in the liquid-phase state produced in the operating medium passages out of the passages, and a recovery section for receiving the operating medium drawn out in the liquid-phase state.

With the above arrangement, the operating medium in the liquid-phase state can be forcibly discharged out of the passages and hence, the amount of operating medium flowing in the gas-phase state in the cooling section can be maintained, whereby the intrinsic condensing performance can be ensured.

BEST MODE FOR CARRYING OUT THE INVENTION

Figure 1:
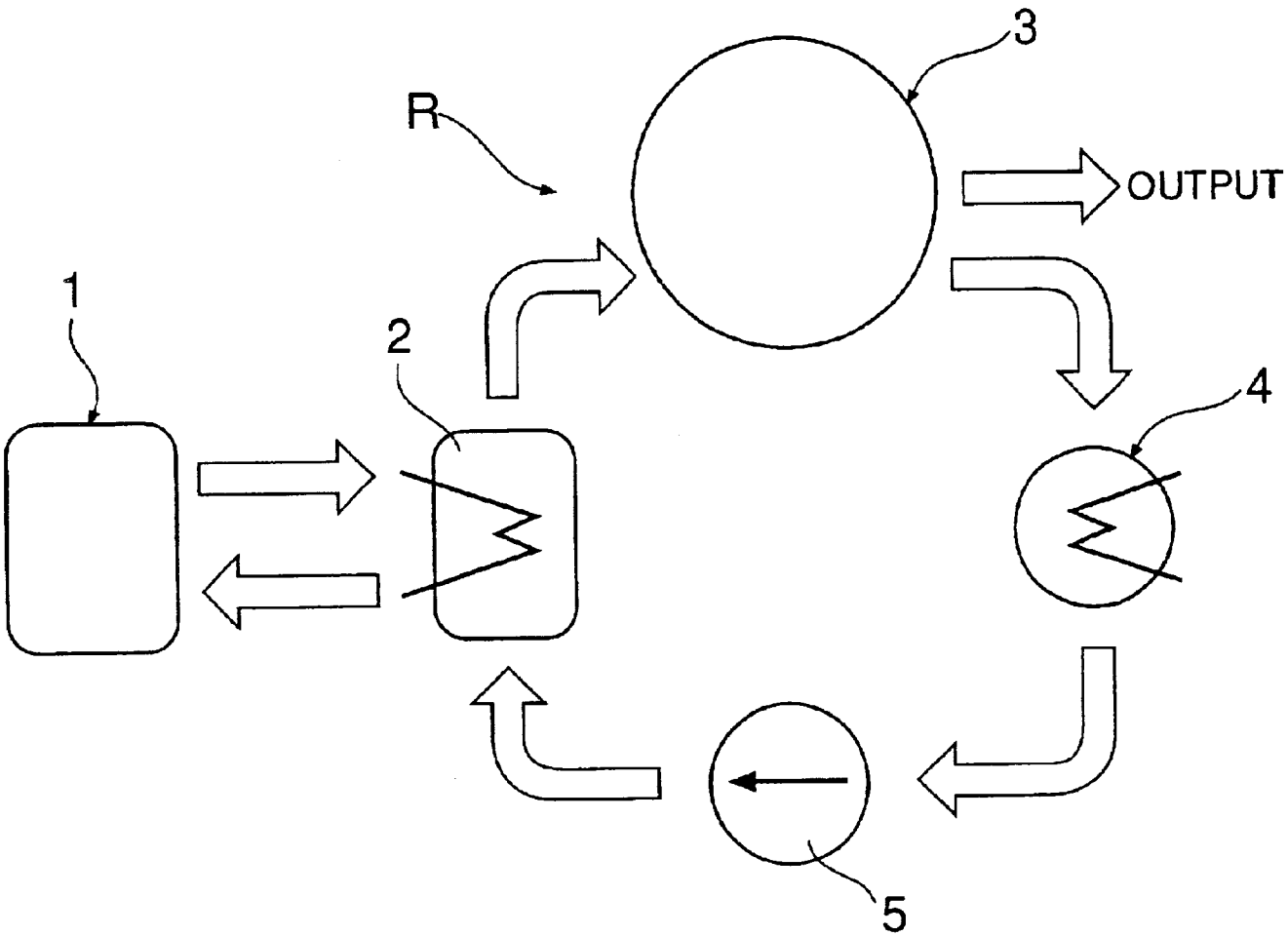
FIG. 1 is an illustration for explaining a Ranking cycle system.

A Rankine cycle system R shown in FIG. 1 includes an evaporator 2 for generating a high-pressure water vapor (an operating medium in the gas-phase state) having a raised temperature, namely, a high-temperature and high-pressure vapor, from a high-pressure liquid, e.g., water (an operating medium in the liquid-phase state) using an exhaust gas from an internal combustion engine 1, an expander 3 for generating an output by the expansion of the high-temperature and high-pressure vapor, a condenser 4 for liquefying the vapor dropped in temperature and pressure by the expansion, namely, a dropped-temperature and dropped-pressure vapor discharged from the expander 3, thereby producing water, and a feed pump 5 for supplying water from the condenser 4 to the evaporator 2 under a pressure.

Figure 2:
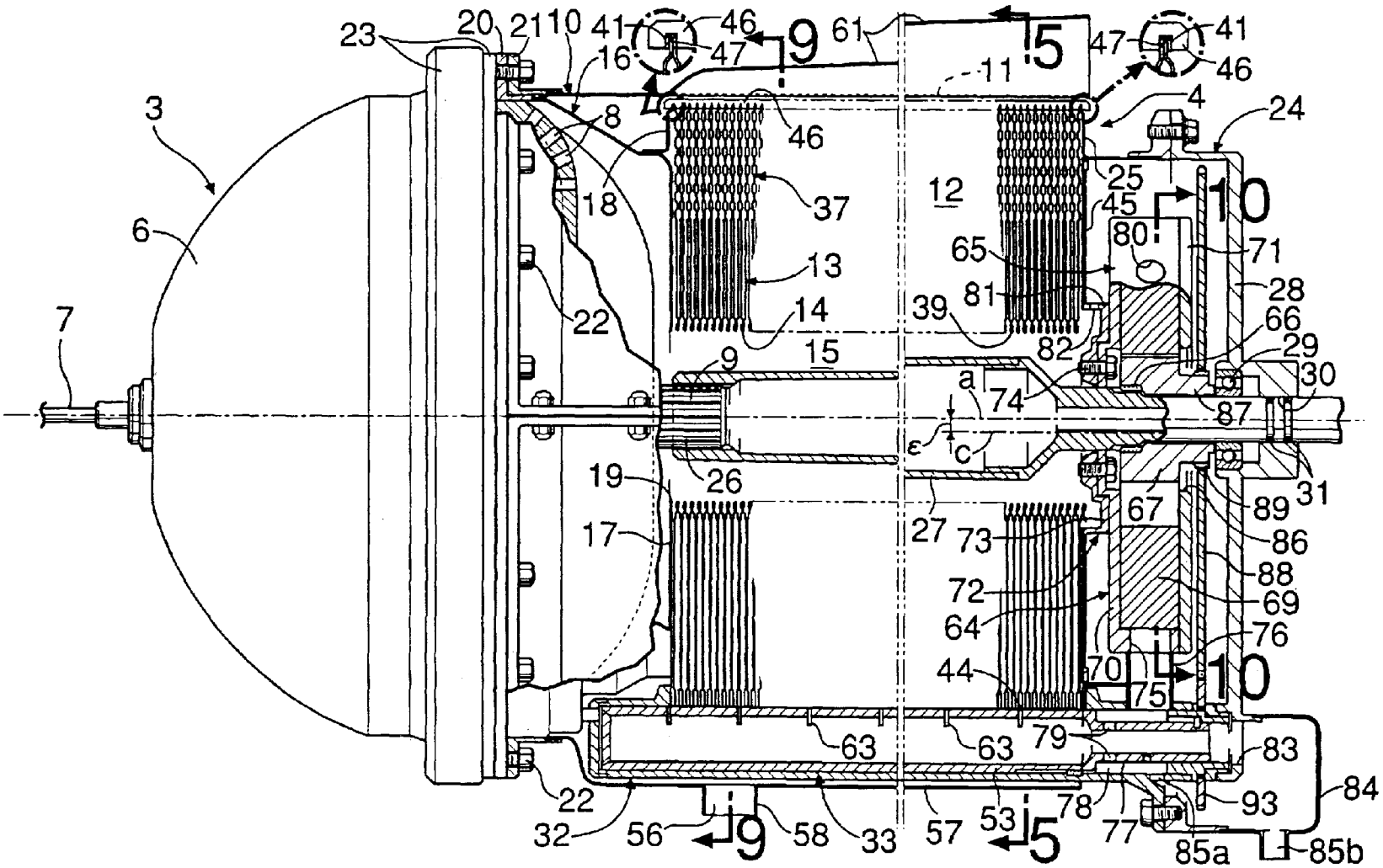
FIG. 2 is a vertical sectional front view of a condenser.

Referring to FIG. 2, the expander 3 includes a substantially horizontal high-temperature and high-pressure vapor introducing pipe 7 at a center portion of one end of a casing 6 of the expander 3, and a plurality of dropped-temperature and dropped-pressure vapor outlet bores 8 in an upper portion of the other end of the casing 6. In addition, the expander 3 includes a substantially horizontal output shaft 9 at a center portion thereof. The condenser 4 is mounted to the expander 3, so that it receives the dropped-temperature and dropped-pressure vapor from each of the outlet bores 8.

The condenser 4 includes a cylindrical housing 10, and a cooling section 12 provided within a larger-diameter tubular portion 11 of the housing 10 for converting the dropped-temperature and dropped-pressure vapor into water. The cooling section 12 is formed into a hollow columnar shape with a plurality of annular panel 13 made of a metal material such as a stainless steel, aluminum and the like and superposed one on another, and is provided at its center portion with a vapor introducing bore 15 provided by the bores 14 in the annular panels 13. The centerline of the vapor introducing bore 15 is in accord with an axis of the output shaft 9.

An annular end plate 17 existing at one end of a tubular vapor guide 16 and a flange 18 existing around an outer periphery of the end plate 17 are opposed to an annular end face of the cooling section 12 on the side of the expander 3. An outer peripheral portion of the flange 18 is integral with the cooling section 12. A bore 19 in the end plate 17 is in accord with the vapor introducing bore 15. A flange 20 existing at the other end of the tubular vapor guide 16 is superposed on a flange 21 existing at one end of the larger-diameter tubular portion 11, and is secured to a flange 23 of the expander 3 by a plurality of bolts 22. Thus, the dropped-temperature and dropped-pressure vapor outlet bores 8 in the expander 3 face into the tubular vapor guide 16.

The housing 10 has a split smaller-diameter tubular portion 24 disposed at the other end of the larger-diameter tubular portion 11. A flange 25 of the smaller-diameter tubular portion 24 is opposed to an annular end face of the cooling section 12, and an outer periphery of the smaller-diameter tubular portion 24 is integral with the cooling section 12.

A transmitting shaft 27 is mounted to the output shaft 9 of the expander 3 through a spline-coupling portion 26. The transmitting shaft 27 protrudes to the outside through the vapor introducing bore 15 in the cooling section 12 and an end wall 28 of the smaller-diameter tubular portion 24, and is rotatably supported at the end wall 28 with a bearing 29 interposed therebetween. Two seal rings 31 are mounted to the transmitting shaft 27 for sealing the transmitting shaft 27 and a shaft insertion bore 30 provided in the end wall 28 outside the bearing 29 from each other.

Figure 3:
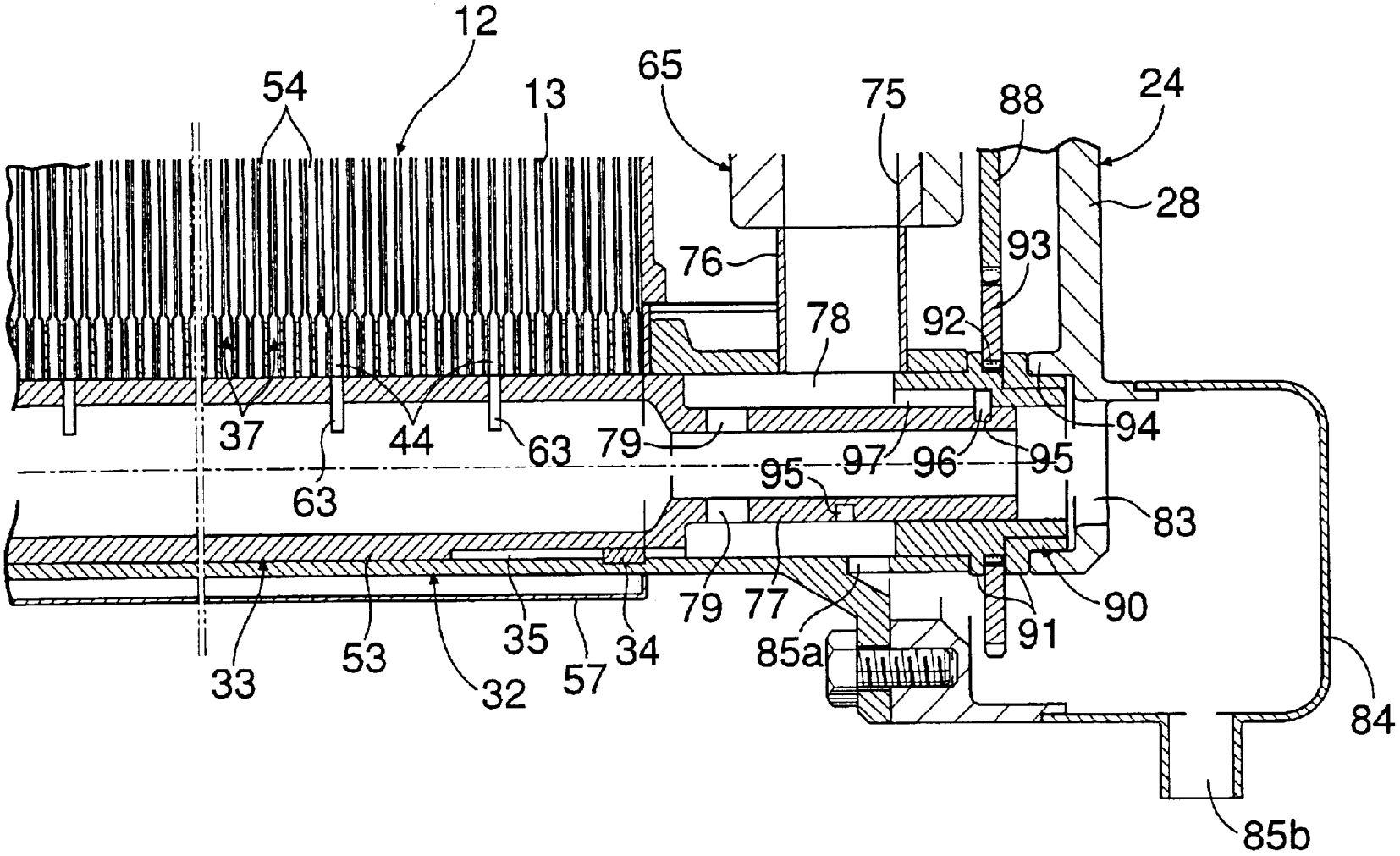
FIG. 3 is an enlarged view of essential portions of FIG. 2.
Figure 4:
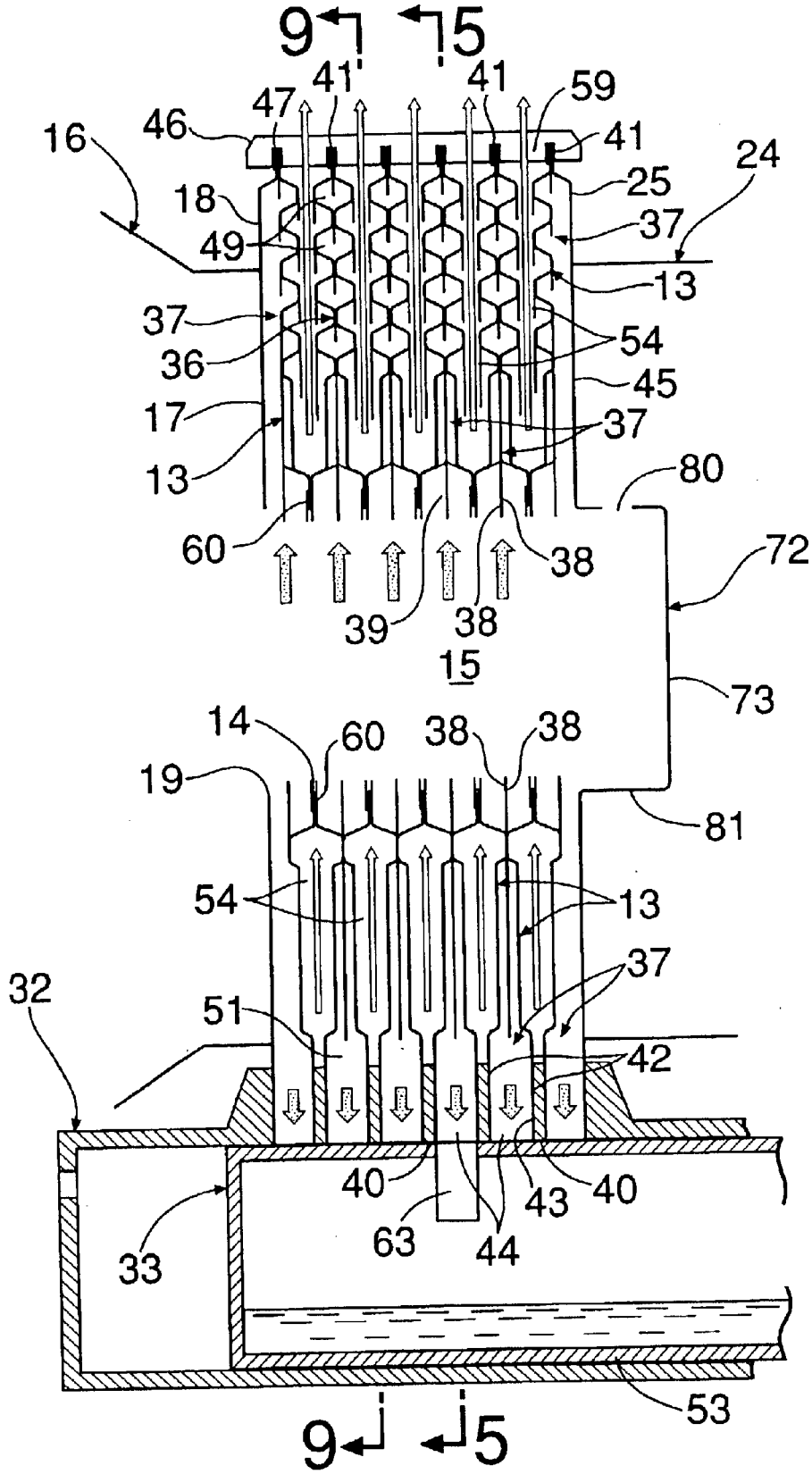
FIG. 4 is a view for explaining one example of a structure of a cooling section and a recovery section, and corresponds to a sectional view taken along a line 4—4 in FIG. 5.

Referring also to FIGS. 3 and 4, the following tubes are disposed in a lower portion of the housing 10: a stationary guide tube 32 extending in parallel to the transmitting shaft 27, and a recovery tube 33 which is slidably fitted in the guide tube 32 and serves as a recovery section for recovering water produced by cooling the dropped-temperature and dropped-pressure vapor. An end of the recovery tube 33 adjacent the expander 3 is closed, but an opposite end of the recovery tube 33 is open. A recovery tube detent means comprising a key 34 and a key groove 35 is provided between an inner peripheral surface of the guide tube 32 and an outer peripheral surface of the recovery tube 33.

Figure 5:
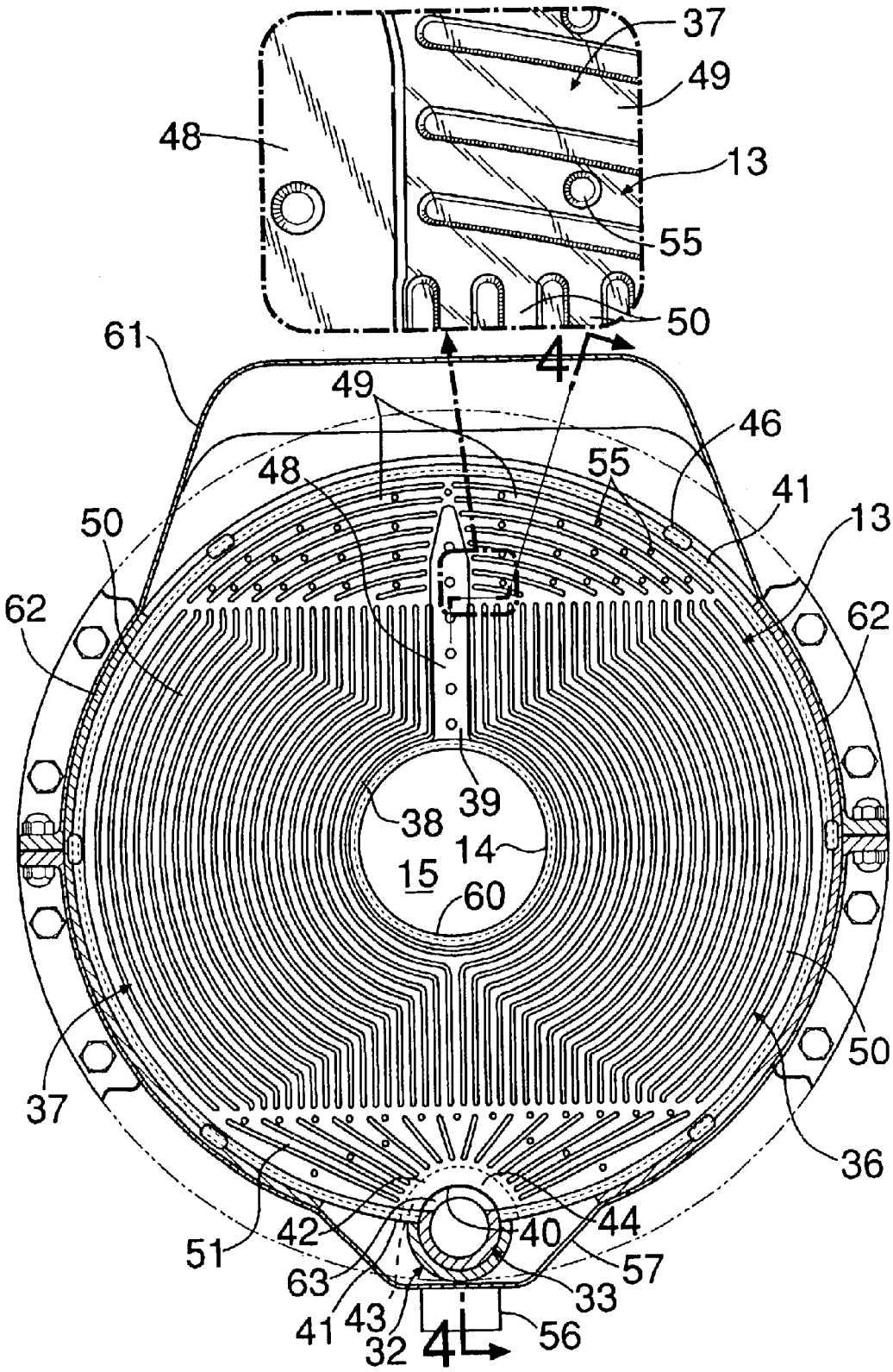
FIG. 5 is a sectional view taken along a line 5—5 in FIG. 2 and corresponds to a sectional view taken along a line 5—5 in FIG. 4.

As shown in FIGS. 4 and 5, each of the annular panels 13 in the cooling section 12 includes a group of projections 36 formed by pressing, and a plurality of tube-shaped vapor passages (operating-medium passages) 37 are defined between a set of the two annular panels 13 by brazing the opposed groups of projections 36 on such set of the two annular panels 13 to each other. The peripheries of the bores 14 in such two annular panels 13 are sealed by brazing of two arcuate projections 38 with their upper portions opened, and an inlet 39 of the vapor passage 37 is defined between opposite ends of the arcuate projections 38 to communicate with an upper portion of the vapor introducing bore 15. Substantially entire outer peripheries of the two annular panels 13 are sealed using a combination of the hemming and the brazing, but hemmed portions 41 are separated at a lower portion and at a notch 40 located on a diameter bisecting the inlet 39. A peripheral portion 42 of the notch 40 is fitted into and brazed in one of a plurality of grooves 43 provided at predetermined distances in an axial direction of the guide tube 32. Thus, an inner peripheral surface of the notch 40 is matched to an inner peripheral surface of the guide tube 32, whereby outlets 44 of the vapor passages 37 defined by the annular panels 13 face into the guide tube 32.

At the end of the cooling section 12 adjacent the expander 3, the vapor passage 37 is defined by cooperation of the one annular panel 13 and the annular end plate 17 as well as the flange 18, and at the end adjacent the smaller-diameter tubular portion 24, the vapor passage 37 is defined by cooperation of the one annular panel 13 and the flange 25 as well as a partition wall 45 on an inner peripheral side of the flange 25. Each of the hemmed portions 41 is fitted into corresponding one of grooves 47 in the comb-shaped distance-adjusting plate 46 extending in a direction of a generating line of the cooling section 12 (also see FIG. 12). A plurality of the distance-adjusting plates 46 are disposed at predetermined distances in a circumferential direction of the cooling section 12.

As shown in FIG. 5, the vapor passages 37 comprise a single rising passage 48 extending upwards on a panel radius from the inlet 39, a plurality of branch passages 49 diverted in opposite directions from the rising passage 48 and in a circumferential direction, a plurality of downcomer passages 50 leading to lower portions of the branch passages 49, a plurality of convergent passages 51 leading to lower portions of the downcomer passages 50, and the outlets 44 where the convergent passages 51 are collected together.

Figure 6:
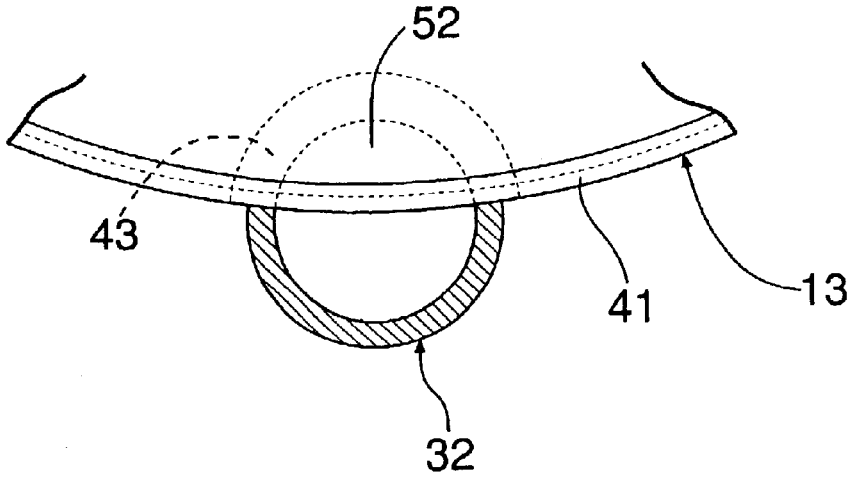
FIG. 6 is a sectional view showing an annular panel in a state in which a portion thereof has been fitted in a groove in a guide tube.
Figure 7:
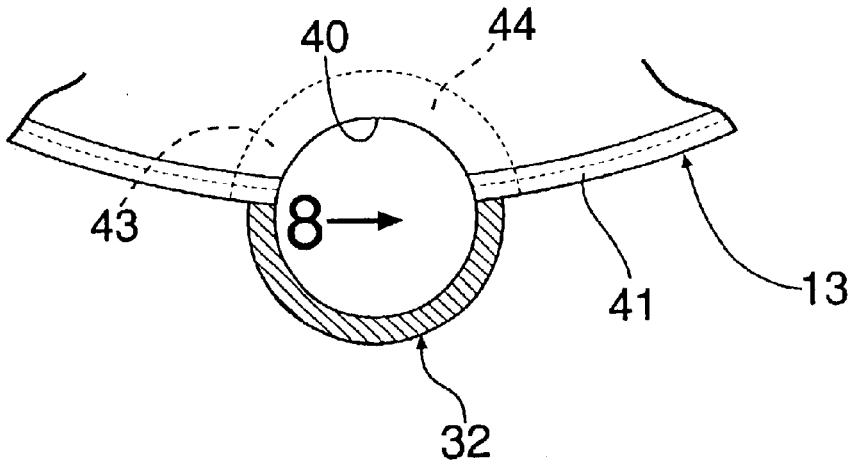
FIG. 7 is a sectional view showing the annular panel in a state in which a portion protruding into the guide tube has been cut away.

To define the outlets 44 of the vapor passages 37, as shown in FIG. 6, portions of the annular panels 13 hemmed over their entire outer peripheral portions, which are on the side of the convergent passages 51, are fitted into the grooves 43 in the guide tube 32, so that a portion of each of the hemmed portions and a portion in the vicinity thereof protrude into the guide tubes 32. Then, the annular panels 13 are brazed to inner surfaces of the grooves 43 in the guide tube 32. Thereafter, portions 52 of the annular panels 13, which protrude into the guide tube 32, are cut away and as a result, the notch 40 is defined, and the outlets 44 open into the notch 40.

Figure 8:
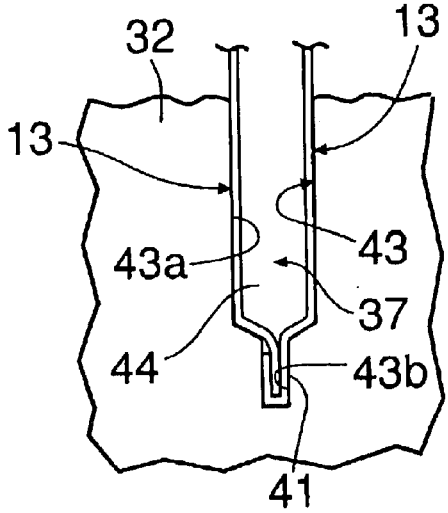
FIG. 8 is a view taken in the direction of an arrow 8 in FIG. 7.

In this case, as shown in FIG. 8, each of the grooves 43 includes a wider portion 43*a* fitted to the two annular panels B, and a narrower portion 43*b* which opens into the a bottom surface of the wider portion 43*a* and is fitted to the hemmed portion 41. Thus, it is possible to reliably seal the peripheries of the outlets 44 and to increase the strength of bonding between each of the panels 13 and the guide tube 32.

Figure 9:
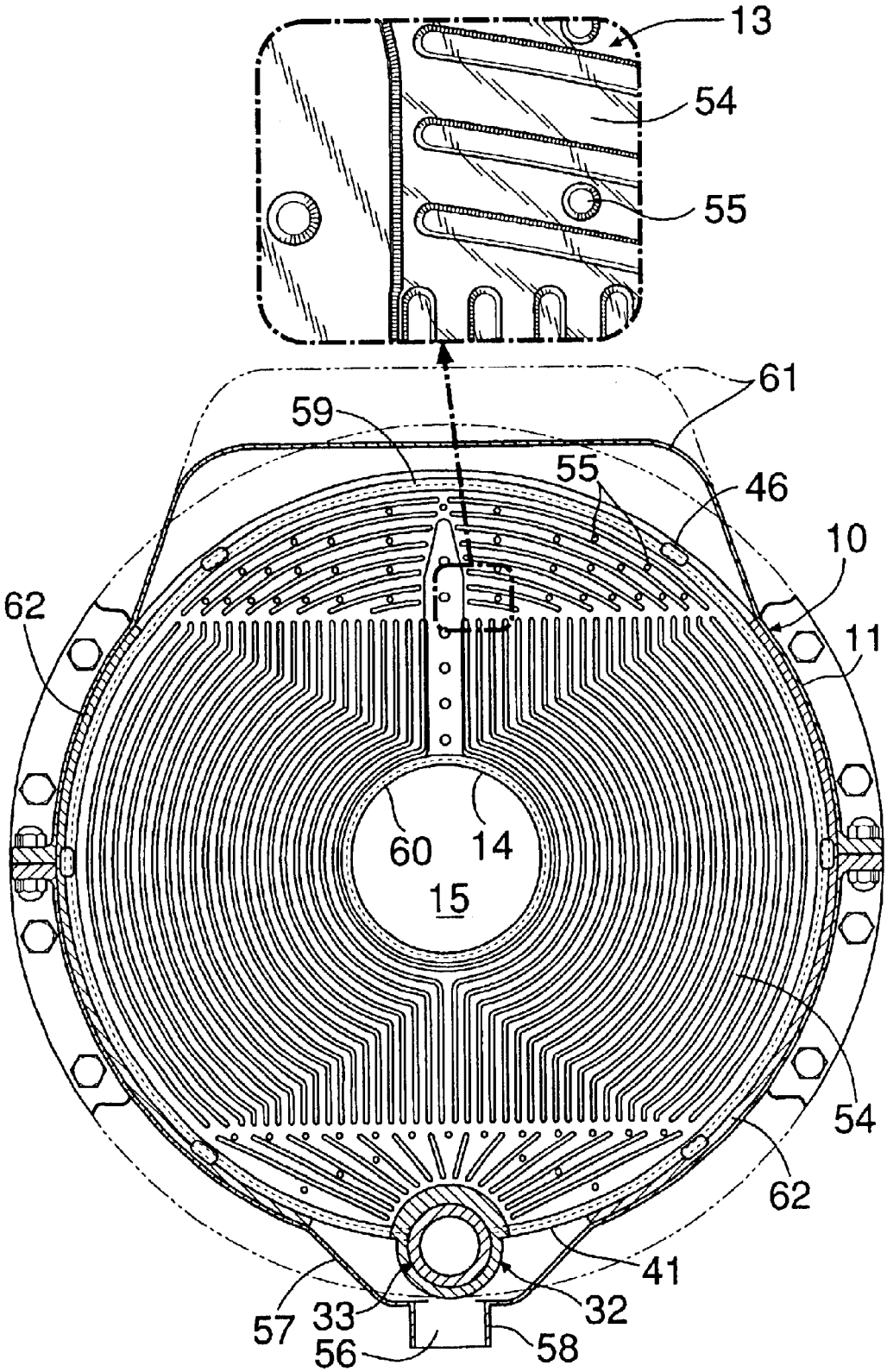
FIG. 9 is a sectional view taken along a line 9—9 in FIG. 2 and corresponds to a sectional view taken along a line 9—9 in FIG. 4.

As shown in FIGS. 4 and 9, each of cooling air passages 54 as cooling medium passages is defined between the adjacent vapor passages 37, namely, is a gap between the two annular panes 13 defining each of the vapor passage 54 and opposed to each other. In order to ensure the air passages 54, the two annular panels 13 are provided with pluralities of small projections 55 mated with each other. Inlets 56 of the air passages 54 are defined by a tube portion 58 existing at a lower bulge 57 of the larger-diameter tubular portion 11 of the housing 10, and on the other hand, outlets 59 of the air passages 54 are located between the adjacent hemmed portions 41 at upper portions of the annular panels 13 defining the vapor passages 37. In the two annular panels 13 defining the air passage 54, inner peripheral edges of the bores 14 therein are bonded to each other by the combination of the hemming and the brazing, and the entering of a cooling air flow into the vapor passages 37 and the leakage of the vapor into the air passages 54 are prevented by a sealing effect provided by such hemmed portions 60. The larger-diameter tubular portion 11 is provided at its upper portion with an exhaust hood 61 covering the outlets 59. On the outer peripheral surface of the cooling section 12, the exhaust hood 61 and the lower bulge 57 are sealed from each other by a pair of side panels 62.

When the outer peripheral portions of the adjacent annular panels 13 defining the vapor passage 37 are bonded by the combination of the hemming and the brazing, as described above, the spreading between both of the outer peripheral portions can be prevented to provide a decrease in air resistance, thereby reducing a loss in pressure in the condenser 4.

A coefficient of condensation heat transfer of the vapor is far larger than a coefficient of convection heat transfer of air and hence, in order to provide the compactness of the cooling section 12, it is required that the heat resistances on a cooling surface of each of the vapor passage 37 and a cooling surface of each of the air passages 54 be equalized to each other by decreasing the area of the cooling surface of the vapor passage 37 and increasing the area of the cooling surface of the air passage 54. Therefore, the groups of projections 36 on the adjacent panels 13 are bonded to each other to define the vapor passages 37 independently into tube shapes. On the other hand, the air passages 54 are defined by maintaining the distances between the adjacent panels 13 constant to provide a structure in which the opposed panels 13 are not in contact with each other, and the area of the cooling surface of each of the air passages 54 is larger than that of the cooling surface of each of the vapor passages 37.

As clearly shown in FIGS. 2 and 3, when the outlets 44 of the vapor passages 37 are classified into a plurality of groups each comprising the same number of outlets 44, a plurality of the outlets 44 in each of the groups intermittently communicate with one of a plurality of circumferentially extending slot-shaped communication bores 63 defined at equal distances in an axial direction in a larger-diameter tubular portion 53 of the recovery tube 33.

Figure 10:
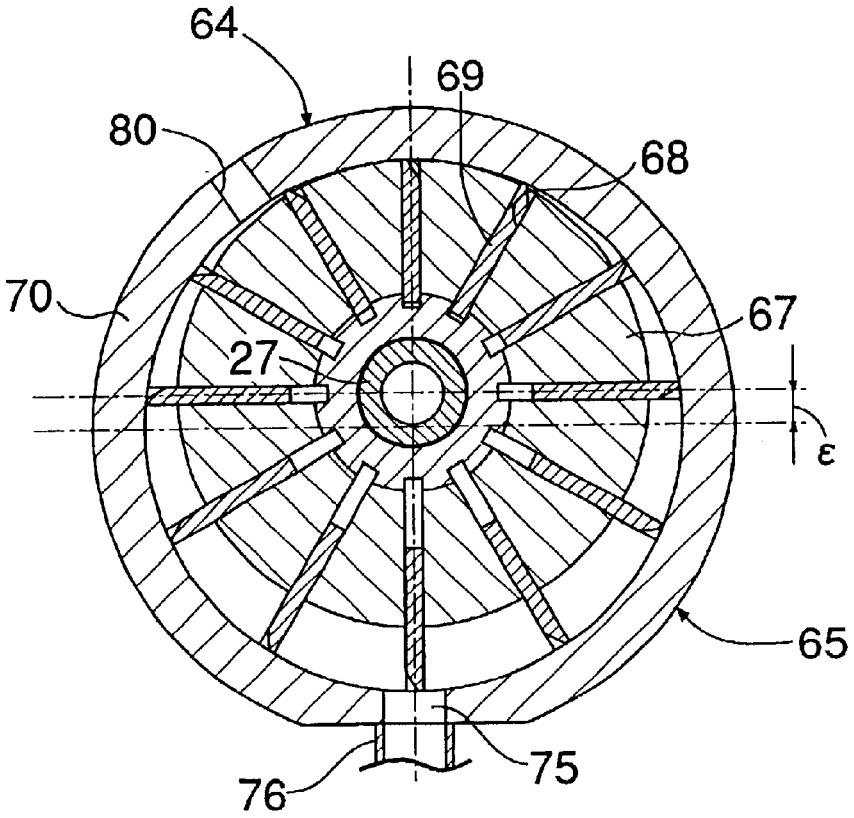
FIG. 10 is a sectional view taken along a line 10—10 in FIG. 2.

As shown in FIGS. 2, 3 and 10, a blower 64 is disposed within the smaller-diameter tubular portion 24 of the housing 10, and serves as a suction means for forcibly drawing water produced in the vapor passages 37 out of the vapor passages 37 via the outlets 44 and the communication bores 63.

The blower 64 comprises a cylindrical casing 65 having a centerline c at a location displaced by $\epsilon$ from an axis a of the transmitting shaft 27, a rotor 67 accommodate in the casing 65 and mounted to the transmitting shaft 27 through a spline coupling 66, and a plurality of vanes 69 slidably fitted into a plurality of radial grooves 68 in the rotor 67. The casing 65 comprises a cylindrical body 70, and a lid 71 attachable and detachable to and from the body 70. The body 70 is mounted to an end wall 73 of a central tubular portion 72 existing on the partition wall 45 by a plurality of bolts 74.

A suction port 75 is provided in a lower portion of the casing 65 and communicates with the larger-diameter tubular portion 53 of the recovery tube 33 via a conduit 76 provided in the guide tube 32, a tubular space 78 between the inner peripheral surface of the guide tube 32 and an outer peripheral surface of a smaller-diameter tubular portion 77 integral with the larger-diameter tubular portion 53 of the recovery tube 33, a plurality of through-bores 79 provided in the smaller-diameter tubular portion 77 and the inside of the smaller-diameter tubular portion 77. On the other hand, a discharge port 80 is provided in an upper portion of the casing 65 and communicates the vapor introducing hole 15 in the cooling section 12 through the inside of the smaller-diameter tubular portion 24 and a through-bore 82 defined in a peripheral wall region 81 on the central tubular portion 72 of the partition wall 45.

A bore 83 permitting the reciprocal movement of the smaller-diameter tubular portion 77 is defined in a lower portion of the end wall 28 of the smaller-diameter tubular portion 24, and a water tank 84 formed by components such as the end wall 28, the guide tube 32 and the like is disposed to surround the bore 83. The inside of the smaller-diameter tubular portion 77 of the recovery tube 33 communicates with an inlet 85*a* of the water tank 84 defined in the peripheral wall of the guide tube 32 through the through-bore 79 and the tubular space 78, and an outlet 85*b* in the water tank 84 communicates with a suction port of the feed pump 5.

To put each of the communication bores 63 provided in the larger-diameter tubular portion 53 of the recovery tube 33 sequentially into communication with the outlets 44 of the vapor passages 37, a drive mechanism for reciprocally moving the larger-diameter tubular portion 53 of the recovery tube 33 within the guide tube 32 is provided in the following manner.

Figure 11:
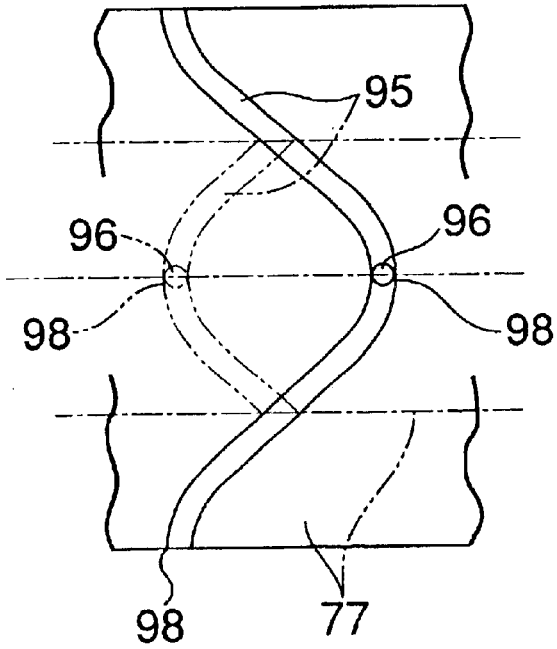
FIG. 11 is a developed view of a cam groove.

A boss 87 is provided at a central portion of the rotor 67 in the blower 64 to protrude from a central bore 86 in the lid 71, and a larger-diameter gear 88 is mounted to the boss 87 through a spline coupling 89. A gear retaining tube 90 is rotatably fitted over the smaller-diameter tubular portion 77 of the recovery tube 33, and a smaller-diameter gear 93 is mounted to the gear retaining tube 90 between a pair of flange-shaped portions 91 of the gear retaining tube 90 through a spline coupling 92 and is meshed with the larger-diameter gear 88. The flange-shaped portions 91 are supported between an end face of the guide tube 32 and an end face of an annular protrusion 94 on an inner surface of a lower portion of the end wall 28. A cam groove 95 is defined in an outer peripheral surface of the smaller-diameter tubular portion 77, as clearly shown in FIG. 11 in a developed manner, and a pin 96 engaged in the cam groove 95 is supported in a groove 97 axially defined in an inner peripheral surface of the gear-retaining tube 90. A distance between chevron portions 98 of the cam groove 95 corresponds to a stroke of the recovery tube 33, and one of the communication bore 63 is sequentially put into communication with the plurality of outlets 44 existing in a range of such stroke, namely, in one group.

In the above-described arrangement, when the output shaft 9 is rotated by the operation of the expander 3, the blower 64 is operated through the transmitting shaft 27, and the larger-diameter gear 88 is rotated. The smaller-diameter gear 93 is also rotated by the rotation of the larger-diameter gear 88 and hence, the recovery tube 33 is reciprocally moved through the pin 96 and the cam groove 95, whereby the plurality of outlets 44 in the vapor passages 37 in each group are intermittently put into communication with the inside of the recovery tube 33 through the communication bores 63 in the recovery tube 33, and a suction force is applied to each of the outlets 44.

The dropped-temperature and dropped-pressure vapor discharged from each of the outlet bores 8 in the expander 3 flows via the inside of the tubular vapor guide 16 into the vapor introducing bores 15 in the cooling section 12 and then enters into each of the vapor passages 37 through the inlet 39. The dropped-temperature and dropped-pressure vapor is then passed via the rising passage 48 and the plurality of branch passages 49 in each of the vapor passages 37 into the plurality of downcomer passages 50, where such vapor is cooled by the cooling air flowing through the plurality of air passages 54 to produce water. The water is forcibly drawn out of the outlets 44 in the vapor passages 37 by the suction force of the blower 64 and accumulated in the larger-diameter tubular portion 53 of the recovery tube 33 via the communication bores 63. When the amount of water accumulated in the larger-diameter tubular portion 53 exceeds a defined amount, the water flows via the smaller-diameter tubular portion 77 as well as the through-bore 79 therein and the tubular space 78 and enters into the water tank 84 through the inlet 85*a*.

When the water produced in each of the vapor passages 37 is forcibly discharged therefrom, the amount of dropped-temperature and dropped-pressure vapor flowing in the cooling section 12 can be maintained, whereby a desired condensation performance can be ensured.

When uncondensed vapor is produced, such vapor is separated from the water by a gas-liquid separating effect provided by the space within the larger-diameter tubular portion 53 of the recovery tube 33 and is then drawn via the smaller-diameter tubular portion 77, the through-bore 79 in the smaller-diameter tubular portion 77, the tubular space 78 and the conduit 76 and through the suction port 75 into the blower 64 by the suction force of the blower 64. Then, such uncondensed vapor is passed from the discharge port 80 via the inside of the smaller-diameter tubular portion 24 and the through-bore 82 in the partition wall 45 into the vapor introducing bore 15 in the cooling section 12 by the feeding action of the vanes 69 of the blower 64 and then returned again into the vapor passages 37, where the uncondensed vapor is liquefied. Thus, it is possible to avoid a decrease in amount of water as the operating medium in the Rankine cycle system R to ensure a required amount of water.

If each of the panels 13 is formed of an aluminum-based material (including pure aluminum and an aluminum alloy) in consideration of the heat conductivity, the surface treatment property, the reduction in weight, the recycling property and the like of the cooling section 12, hydrogen which is a non-condensed gas is produced by a chemical reaction between the dropped-temperature and dropped-pressure vapor, namely, the water vapor and the aluminum-based material, and most of the hydrogen is discharged to the outside of the vapor passages 37 by the water, but there is a possibility that a portion of the discharged hydrogen may be resident within the narrow vapor passages 37 and as a result, the cooling effect for the dropped-temperature and dropped-pressure vapor may be obstructed by the resident hydrogen. In the present embodiment, however, if hydrogen is produced, then such hydrogen can be circulated in a path comprising the cooling section 12, the recovery tube 33, the blower 64 and the cooling section 12 and thus prevented from being resident within the vapor passages 37.

In addition, even if the distance between the adjacent panels 13 in the cooling section 12 is decreased to the utmost, the residence of the water can be avoided by forcibly discharging the water from the vapor passages 37. Thus, it is possible to provide a reduction in size of the cooling section 12 and to enhance the mountability of the condenser 4 in the Rankine cycle system R for the vehicle.

Further, the outlets 44 in the plurality of vapor passages 37 in each group and each of the communication bores 63 of the recovery tubes 33 are intermittently put into communication with each other, and hence, even if a blower of a lower capacity is used as the blower 64, a large suction force can be applied to each of the outlets 63, thereby providing an energy-saving. The energy-saving is particularly effective, because an output from the expander 3 is utilized as a power source for the blower 64.

Yet further, the cylindrical cooling section 12 and the blower 64 are accommodated in a projected plane of the flange 23 of the expander 3, and the dropped-temperature and dropped-pressure vapor introducing bore 15 in the cooling section 12 is provided around the centerline of the projected plane and hence, it is possible to provide the compactness of an assembly comprising the expander 3 and the condenser 4 provided with the blower 64.

Figure 12:
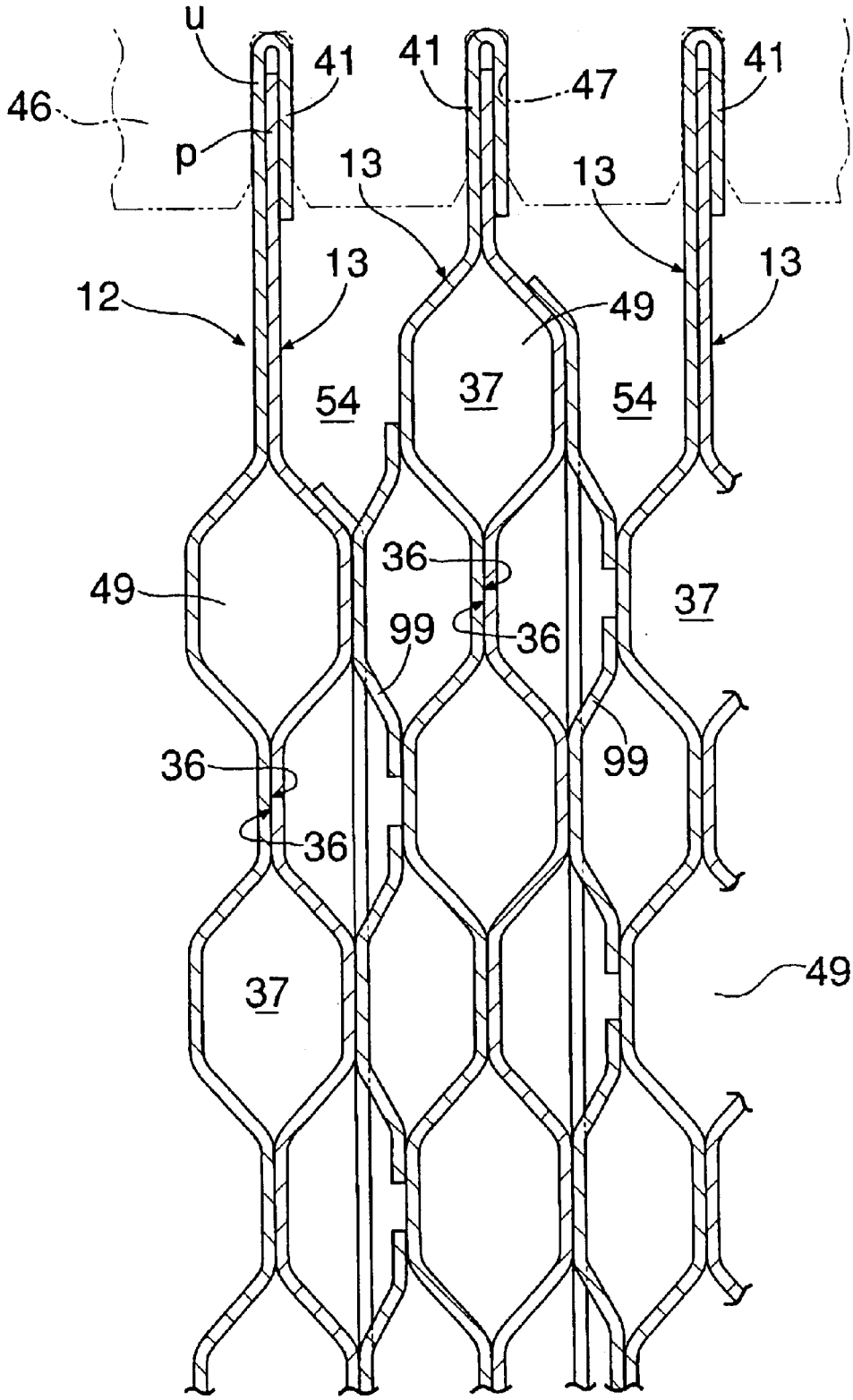
FIG. 12 is a sectional view of essential portions of an another example of a cooling section.

FIG. 12 shows another example of the cooling section 12. In this example, in a state in which a distance-adjusting leaf spring 99 has been interposed between the adjacent panels 13 defining the air passage 54, a laminate comprising the panels 13 and the leaf springs 99 is placed on a preselected jig, and the hemmed portions 41 and the mated groups of projections 36 are brazed.

Thus, the hemmed portions 41 and the opposed projections 36 in contact with each other by the repulsing force of the leaf springs 99 can be bonded reliably, whereby the strength and reliability of the bonding can be enhanced, and the distance between the air passages 54 can be maintained at a predetermined value. In this case, if two brazing materials placed at portions to be hemmed prior to the hemming are clamped between opposed inner surfaces of a U-shaped portion u produced by the hemming and opposite surfaces of a flat plate-shaped portion p located between such opposed inner surfaces, respectively, the operation for brazing each of the hemmed portions 41 can be facilitated, and the bonding strength can be increased. This also applies to each of the hemmed portions 60.

Figure 13:
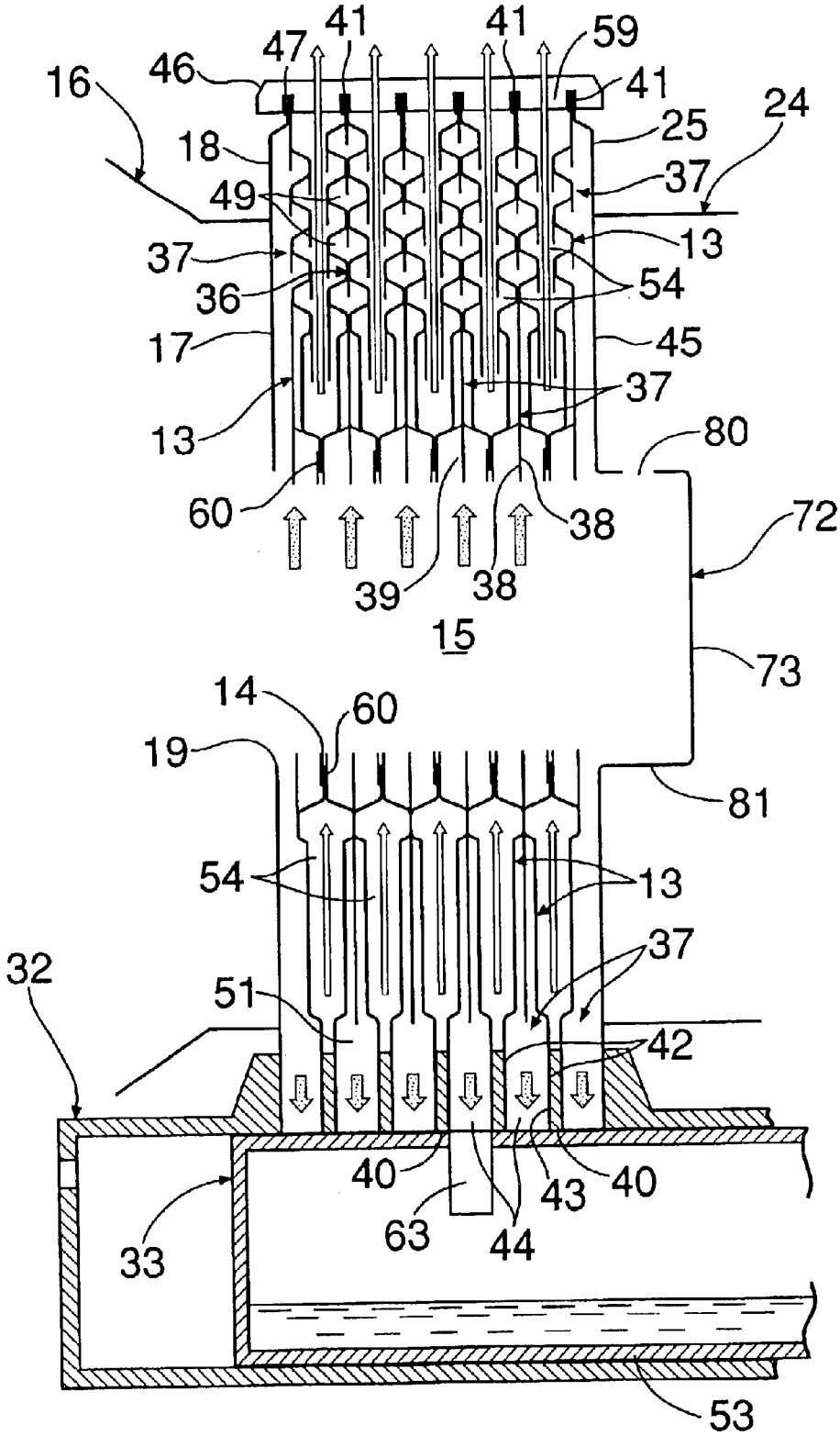
FIG. 13 is a view showing another example of a structure of a cooling section and a recovery section.

In this example, two types of the annular panels 13 are used, which have groups of projections 36 disposed at different locations, so that the branch passages 49 in the adjacent vapor passages 37 are disposed in a zigzag manner. The entire structure of the cooling section 12 constructed using such annular panels 13 is as shown in FIG. 13.

What is claimed is:

1. A condenser comprising:

a cooling section having a plurality of operating medium passages to convert an operating medium in a gas-phase state into a liquid-phase state;

a recovery section for receiving said operating medium in the liquid-phase state;

a feed pump which receives at a suction port thereof the operating medium in the liquid-phase state via a water tank which communicates with said recovery section; and a suction means associated with a portion extending between said recovery section and said water tank for forcibly drawing the operating medium passages out of said passages.

2. The condenser according to claim 1, wherein a suction side of the suction means communicates with outlets of said operating medium passages, and a discharge side of the suction means communicates with inlets of said operating medium passages.

3. The condenser according to claim 1, the cooling section being provided within a tubular portion of a condenser housing.

4. The condenser according to claim 1, wherein the recovery section is a tube disposed in a lower portion of the housing.

5. The condenser according to claim 1, wherein the cooling section includes a plurality of annular panels with projections.

6. The condenser according to claim 2, wherein the outlets of said operating medium passages are defined by annular panels of the cooling section which face into a guide tube surrounding the recovery section.

7. The condenser according to claim 1, the recovery section being tube-shaped.

8. The condenser according to claim 1, the cooling section having a vapor introducing bore provided by annular panels of the cooling section.

9. The condenser according to claim 8, further comprising a transmitting shaft connected to a output shaft, the transmitting shaft and the output shaft extending through the vapor introducing bore of the cooling section.

10. The condenser according to claim 8, wherein the transmitting shaft rotates the rotor of the suction means.

* * * * *

UNITED STATES PATENT AND TRADEMARK OFFICE

CERTIFICATE OF CORRECTION

PATENT NO. : 6,843,309 B2
DATED : January 18, 2005
INVENTOR(S) : Taniguchi, Hiroyoshi et al.

It is certified that error appears in the above-identified patent and that said Letters Patent is hereby corrected as shown below:

Title page,
Item [30], Foreign Application Priority Data, "Jan. 25, 2001" should be
-- Jan. 26, 2000 --

Signed and Sealed this

Thirty-first Day of May, 2005

JON W. DUDAS
*Director of the United States Patent and Trademark Office*